US008172726B1

(12) United States Patent
Leier

(10) Patent No.: US 8,172,726 B1
(45) Date of Patent: May 8, 2012

(54) DOORWAY MOUNTED HORIZONTAL BAR

(75) Inventor: Christopher Henry Leier, Puyallup, WA (US)

(73) Assignees: Expectations, LLC, Puyallup, WA (US); Inversion International, Ltd., New Providence Island (BS)

( * ) Notice: Subject to any disclaimer, the term of this patent is extended or adjusted under 35 U.S.C. 154(b) by 0 days.

(21) Appl. No.: 12/925,176

(22) Filed: Oct. 15, 2010

(51) Int. Cl.
*A63B 21/00* (2006.01)

(52) U.S. Cl. ..... 482/23; 482/904; 482/35; 482/36

(58) Field of Classification Search ..... 182/116, 182/156, 106; D25/69; 403/93; 482/904, 482/23, 35, 36, 40
See application file for complete search history.

(56) References Cited

U.S. PATENT DOCUMENTS 3,915,452 A * 10/1975 Winblad ..... 482/40
4,405,127 A 9/1983 Miller
4,458,894 A * 7/1984 Dudley ..... 482/40
4,529,191 A 7/1985 Miller et al.
4,844,448 A * 7/1989 Niznik ..... 482/40
5,417,628 A * 5/1995 Vanderbleek ..... 482/40
6,994,655 B2 2/2006 Chu
D554,209 S * 10/2007 Loucks ..... D21/694
7,621,847 B2 * 11/2009 Lamle et al. ..... 482/40
D633,156 S * 2/2011 Caswell et al. ..... D21/679

* cited by examiner

*Primary Examiner* — Jerome W Donnelly
(74) *Attorney, Agent, or Firm* — Charles E. Baxley

(57) ABSTRACT

A doorway mounted horizontal bar includes a rod having two ends for attaching to two side moldings of a doorway, two frames attached to the end portions of the rod for supporting a tubular member, and two auxiliary supports each having a lower segment attached to the rod and each having an upper handle attached to the upper end of the frame for being grasped by the user, the lower segments of the auxiliary supports are each attached to the rod with a coupling device, and the handles of the auxiliary supports are each attached to the frame with another coupling device, the coupling devices each include a quick release fastening device for detachably securing the coupling devices and the auxiliary supports to the rod and the frames.

14 Claims, 7 Drawing Sheets

DOORWAY MOUNTED HORIZONTAL BAR

BACKGROUND OF THE INVENTION

1. Field of the Invention

The present invention relates to a doorway mounted horizontal bar, and more particularly to a doorway mounted horizontal bar including one or more longitudinal or lateral bars or rods or handles and including a parallel bar structure or device for allowing the user to conduct various kinds of exercises with a single exercising mechanism or apparatus without additional parallel bar structure or device.

2. Description of the Prior Art

Typical doorway mounted horizontal bars comprise tubular members freely telescopically interconnected having lateral extending end plates wedged-shaped and received in doorway brackets on opposite sides of the doorway for adjustably or suitably attached or mounted or secured between the opposite sides of the doorway.

For example, U.S. Pat. No. 4,405,127 to Miller discloses one of the typical doorway mounted horizontal bars comprising tubular members freely telescopically interconnected having lateral extending end plates for attaching or mounting to opposite sides of the doorway with brackets, and for adjustably or suitably attaching or mounting to the doorways of different widths or dimensions or lateral sizes.

However, the typical doorway mounted horizontal bar includes a single longitudinal or lateral bar or rod or handle that may be used to conduct only one kind of exercise, but may not be used to conduct the parallel bar exercise exercises, such that the users have to purchase an additional parallel bar structure or device for allowing the user to conduct the parallel bar exercises.

U.S. Pat. No. 4,529,191 to Miller et al. discloses another typical doorway mounted horizontal bar also comprising tubular members freely telescopically interconnected having lateral extending ends depending to outward facing U-shaped members having sufficient width to be disposed about the respective sides of a doorway with brackets, and to have a frictional engagement therewith.

However, similarly, the typical doorway mounted horizontal bar includes a single longitudinal or lateral bar or rod or handle that may be used to conduct only one kind of exercise, but may not be used to conduct the parallel bar exercise exercises, such that the users have to purchase an additional parallel bar structure or device for allowing the user to conduct the parallel bar exercises.

U.S. Pat. No. 6,994,655 to Chu discloses a further typical horizontal bar comprising two side supports each including an upper end provided with symmetrical locating holes, a top bar connected to the locating holes of the side supports, and a swing member including horizontally paralleled upper and lower bars connected to each other with connecting plates vertically extended between the upper and lower bars.

However, similarly, the typical horizontal bar also includes a single longitudinal or lateral bar or rod or handle that may be used to conduct only one kind of exercise, but may not be used to conduct the parallel bar exercise exercises, such that the users have to purchase an additional parallel bar structure or device for allowing the user to conduct the parallel bar exercises.

The present invention has arisen to mitigate and/or obviate the afore-described disadvantages of the conventional doorway mounted horizontal bars.

SUMMARY OF THE INVENTION

The primary objective of the present invention is to provide a doorway mounted horizontal bar including one or more longitudinal or lateral bars or rods or handles and including a parallel bar structure or device for allowing the user to conduct various kinds of exercises with a single exercising mechanism or apparatus without additional parallel bar structure or device.

In accordance with one aspect of the invention, there is provided a doorway mounted horizontal bar comprising a rod including two end portions for attaching to two side moldings of a doorway, two frames attached to the end portions of the rod respectively and each including an upper end, a tubular member coupled between the upper ends of the frames for being grasped by a user, and two auxiliary supports each including a lower segment attached to the rod, and each including an upper handle attached to the upper end of the frame for being grasped by the user and for allowing the user to conduct the parallel bar exercises with a single exercising mechanism or apparatus without additional parallel bar structure or device.

The lower segments of the auxiliary supports are each attached to the rod with a coupling device, for example, the coupling device includes a barrel for receiving and engaging with the lower segment of the auxiliary supports and includes a holder having a compartment formed therein for receiving and engaging with the rod.

The barrel includes a channel formed therein for slidably receiving and engaging with a fastener which is secured to the lower segment of the auxiliary supports for adjustably attaching or mounting the coupling device to the lower segment of the auxiliary supports, it is preferable that the holder includes a semi-cylindrical structure having a U-shaped cross section and having the compartment formed therein for receiving and engaging with the rod.

The coupling device includes a groove formed between the barrel and the holder for receiving and engaging with a quick release fastening device and for detachably and adjustably and easily and quickly attaching or mounting and securing the coupling device and the auxiliary support to the rod with the quick release fastening device.

The quick release fastening device includes a strap for engaging through the groove of the coupling device and for engaging around the holder and the rod and thus for easily and quickly attaching or mounting and securing the coupling device and the auxiliary support to the rod.

The handles of the auxiliary supports are each attached to the frame with a coupling device, for example, the coupling device includes a barrel for receiving and engaging with the handle and includes a holder having a compartment formed therein for receiving and engaging with the frame.

The barrel includes a channel formed therein for slidably or adjustably receiving and engaging with a fastener which is secured to the handle for slidably or adjustably or suitably mounting the coupling device to the handle at the required or selected location or position.

The holder includes a semi-cylindrical structure having a U-shaped cross section and having the compartment formed therein for receiving and engaging with the frame and for detachably and easily and quickly attaching or mounting and securing the holder to the frame.

The coupling device includes a groove formed between the barrel and the holder for receiving and engaging with a quick release fastening device and for detachably and adjustably and easily and quickly attaching or mounting and securing the coupling device and the auxiliary support to the frame.

The quick release fastening device includes a strap for engaging through the groove of the coupling device and for engaging around the holder and the frame and thus for easily and quickly attaching or mounting and securing the coupling device and the auxiliary support to the frame.

The frame includes a lower pole and an upper pole having a coupling portion secured to the rod, an outwardly extended segment for engaging with the side moldings, and includes a brace attached to the lower and the upper poles for reinforcing the lower and the upper poles and for forming a stable triangular structure, and the tubular member is coupled between the braces of the frames.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
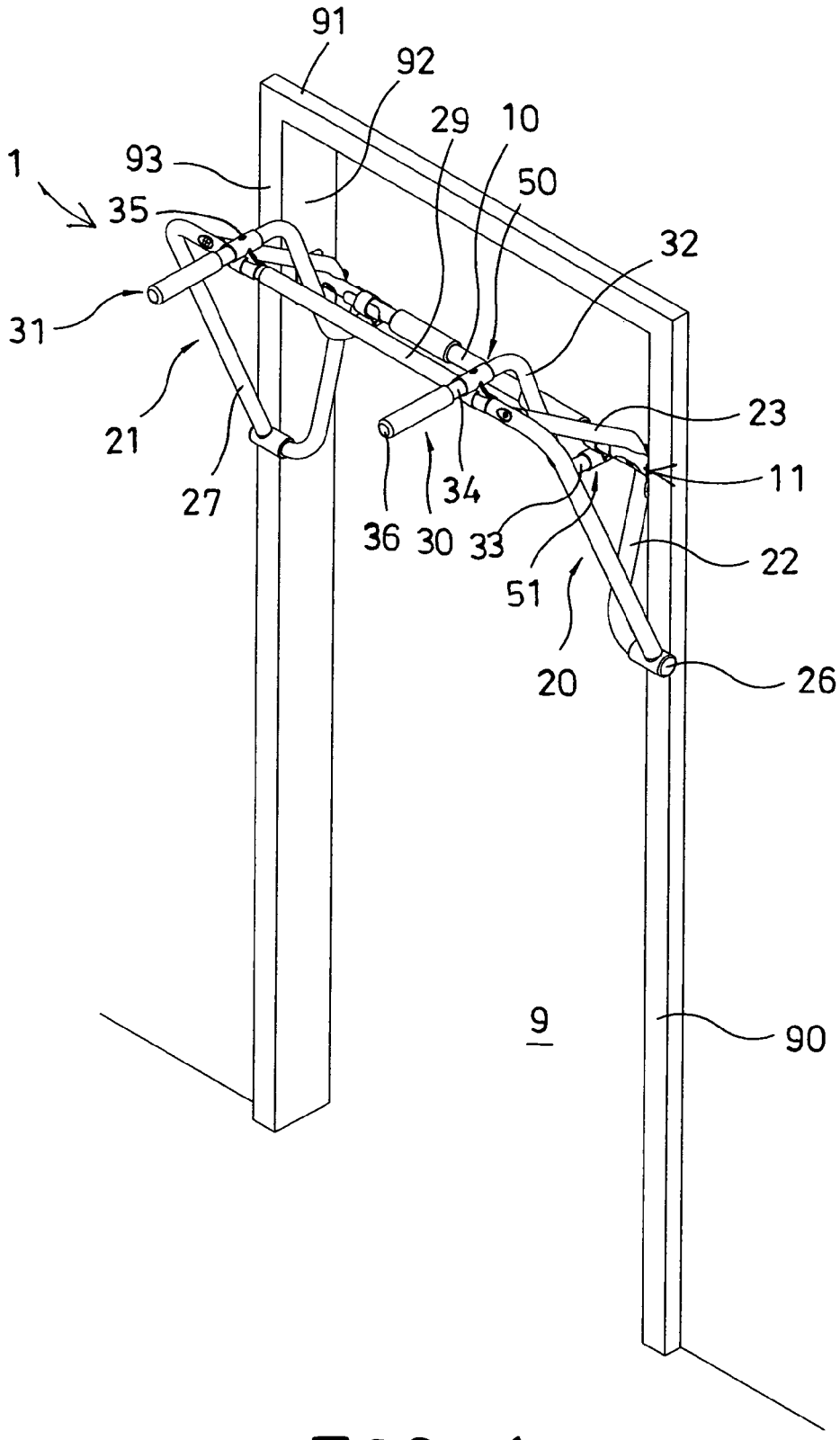
FIG. 1 is a perspective view illustrating the attachment of a doorway mounted horizontal bar in accordance with the present invention onto a doorway.
Figure 2:
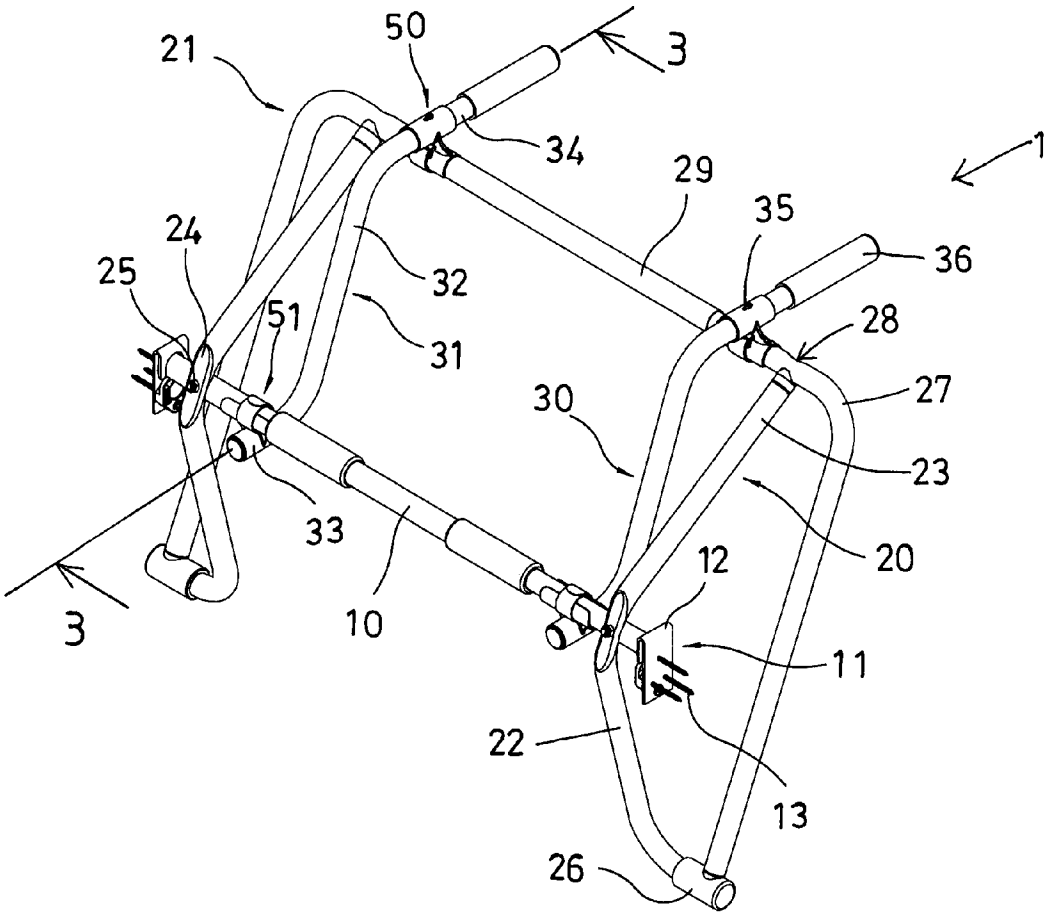
FIG. 2 is a perspective view of the doorway mounted horizontal bar.
Figure 7:
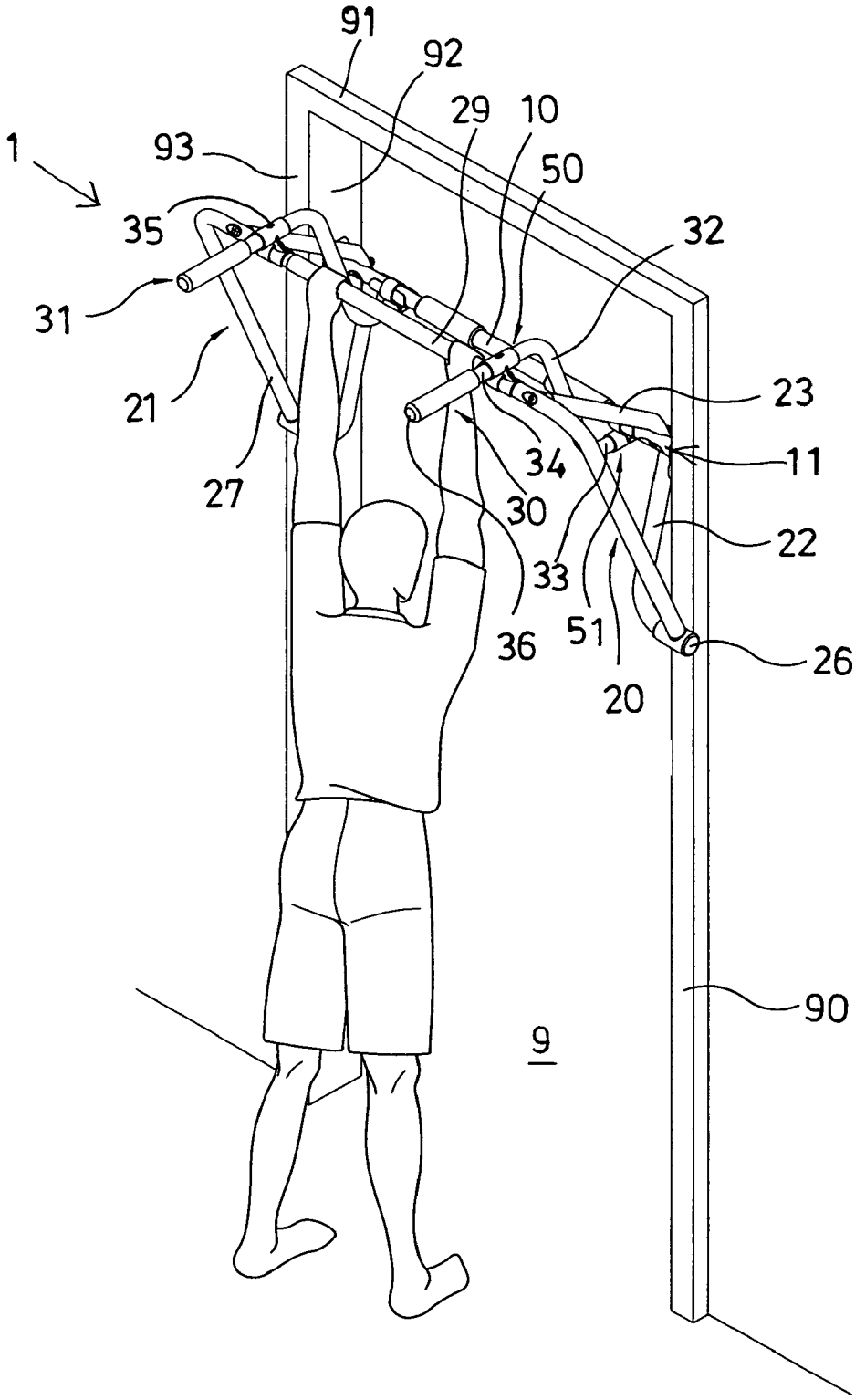
FIGS. 7, 8 are perspective views illustrating the operation of the doorway mounted horizontal bar.
Figure 8:
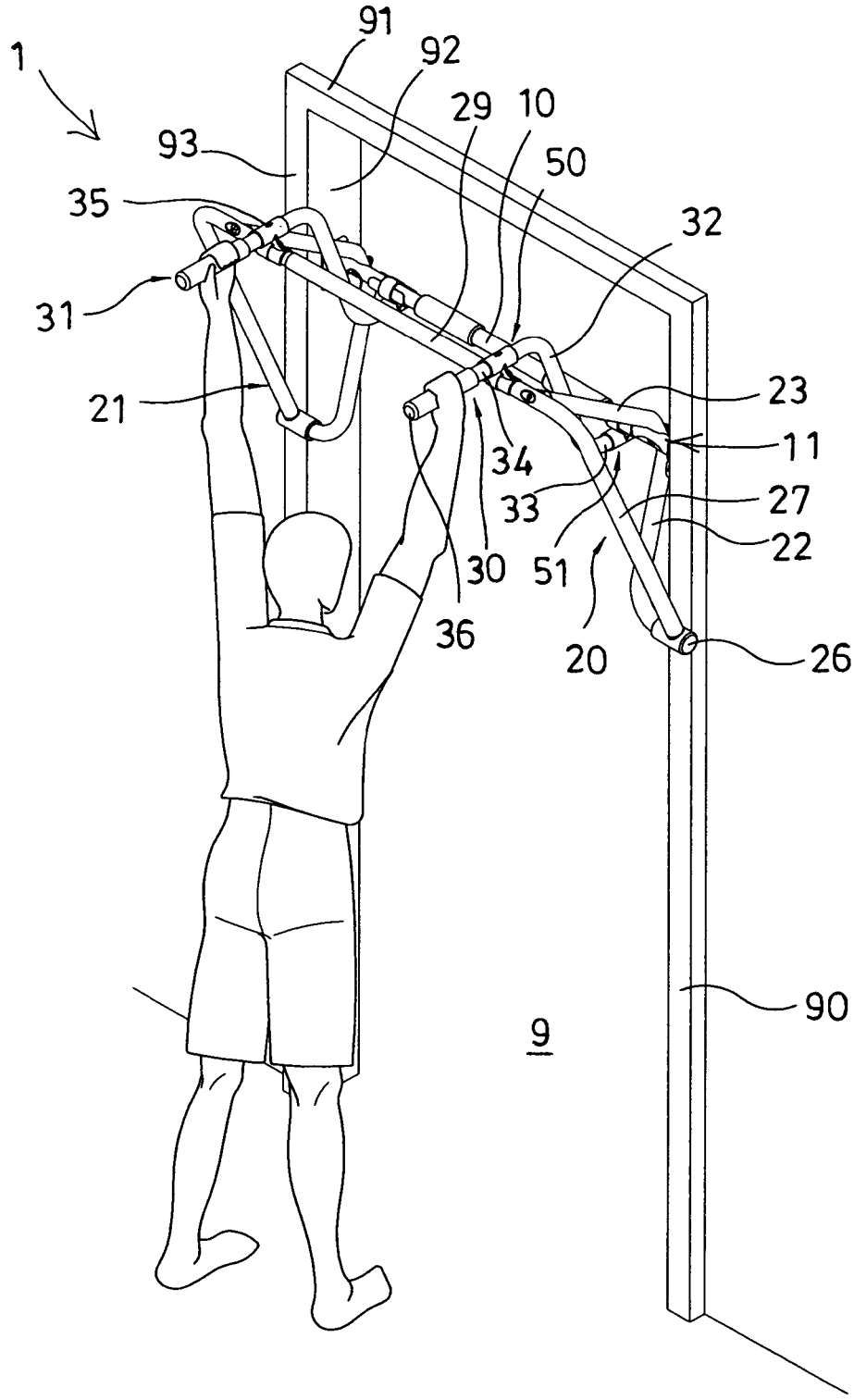

Referring to the drawings, and initially to FIGS. 1 and 7-8, a doorway mounted horizontal bar in accordance with the present invention is generally indicated with a reference numeral "1" and is designed and arranged to be attached or mounted or secured or coupled to the typical doorway 9, in which the doorway 9 includes two side beams or moldings 90, and a lintel 91 provided and attached between the upper portions of the side beams or moldings 90, and the side beams or moldings 90 each include an inner portion or surface 92 and a front or outer portion or surface 93. The doorway mounted horizontal bar 1 in accordance with the present invention comprises a lateral or longitudinal rod 10 including a telescopic structure and including two end portions 11 for attaching or mounting or securing to the inner surfaces 92 of the side moldings 90 with brackets or end plates 12 and latched or fasteners 13 or the like (FIG. 2).

Figure 3:
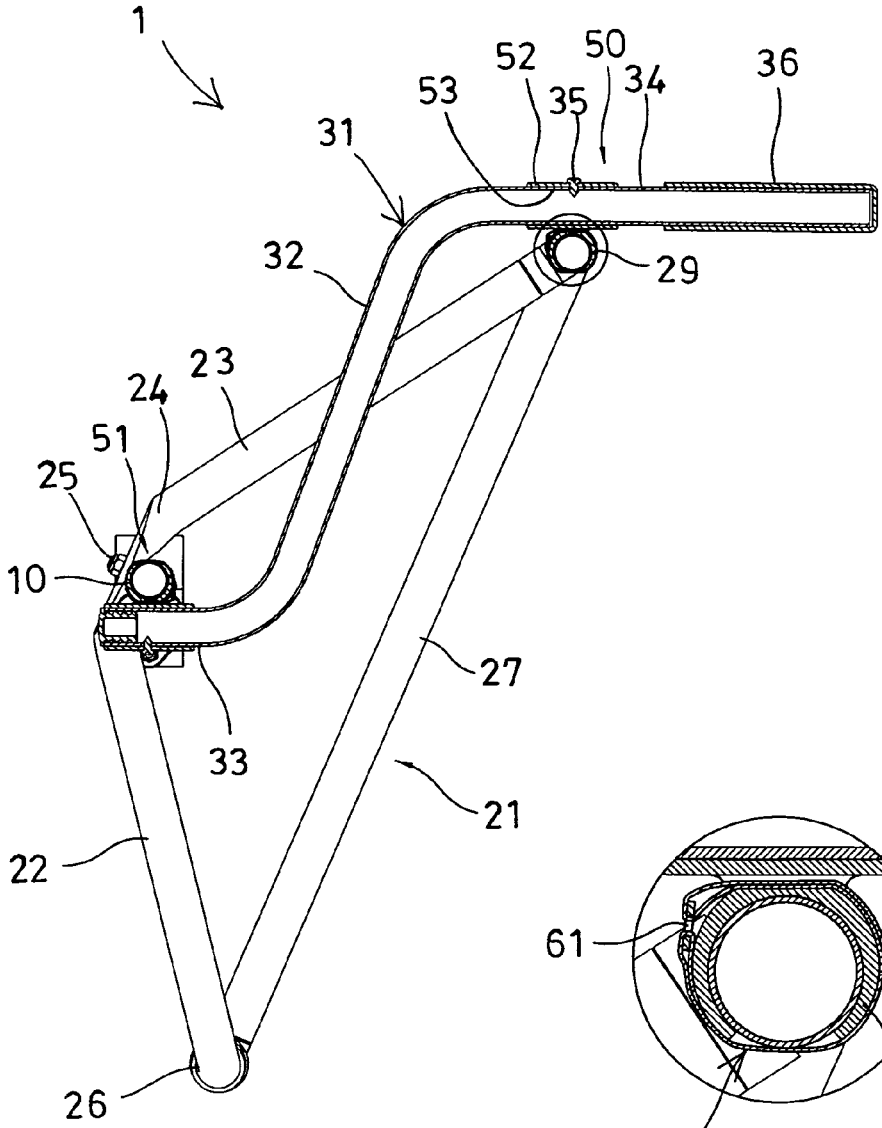
FIG. 3 is a partial cross sectional view of the doorway mounted horizontal bar taken along lines 3-3 of FIG. 2.
Figure 4:
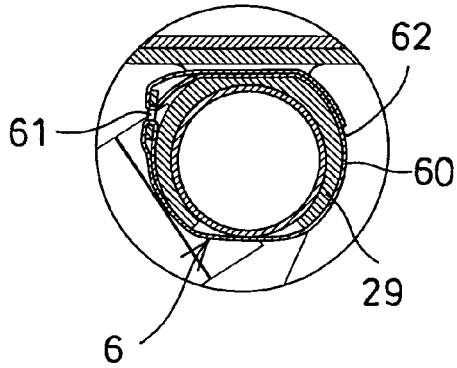
FIG. 4 is an enlarged partial cross sectional view of the doorway mounted horizontal bar.
Figure 5:
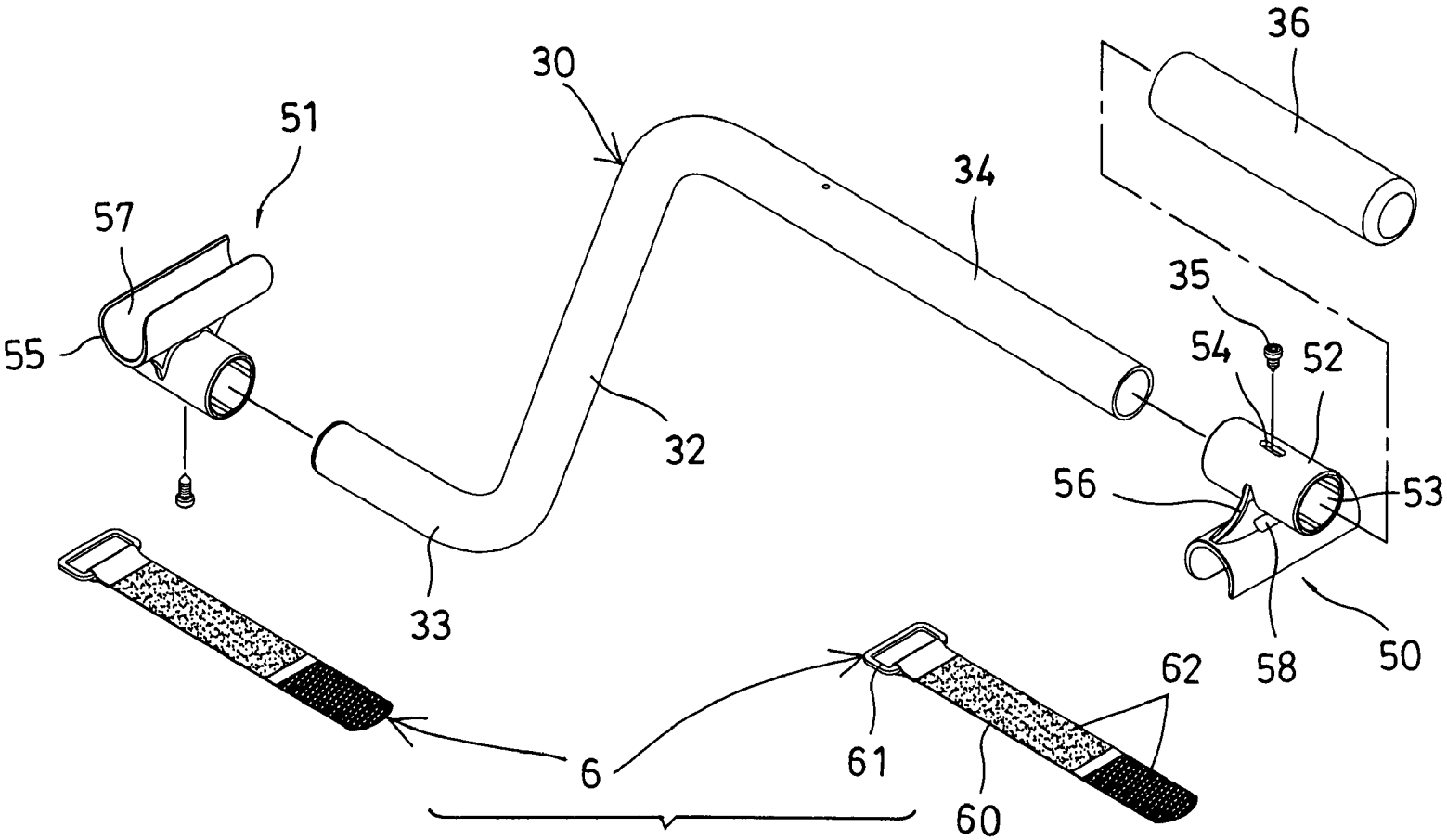
FIG. 5 is a partial exploded view of the doorway mounted horizontal bar.
Figure 6:
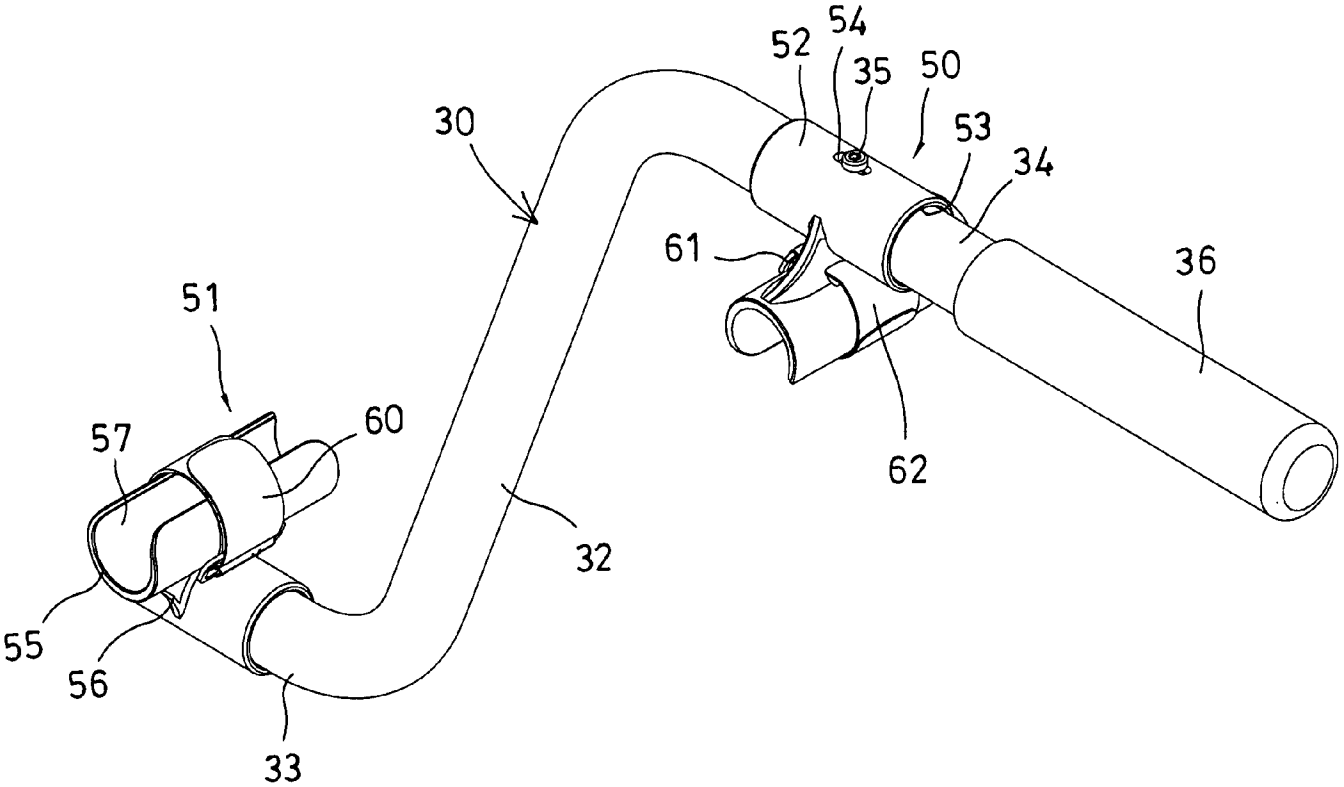
FIG. 6 is a perspective view illustrating a portion of the doorway mounted horizontal bar.

The structure of the longitudinal rod 10 and the attachment of the longitudinal rod 10 to the inner surfaces 92 of the side moldings 90 are typical and will not be described in further details. As shown in FIGS. 1-3, two brackets or frames 20, 21 are attached or mounted or secured to the end portions 11 of the rod 10 respectively and each include a lower pole 22 which is extended and located below the rod 10 and an upper pole 23 which is extended and located above the rod 10, and an adjacent or coupling portion 24 formed or provided between the lower and the upper poles 22, 23 for attaching or mounting or securing to the rod 10 with latched or fasteners 25 or the like, and each include an outwardly extended leg or segment 26 formed or extended from the lower end of the lower pole 22 for engaging with the front or outer portions or surfaces 93 of the side moldings 90, it is to be noted that the distance between the outwardly extended segments 26 of the lower poles 22 is greater than the length of the rod 10 for suitably engaging with the outer surfaces 93 of the side moldings 90.

The frames 20, 21 each further include a link or stay or brace 27 attached or mounted or secured or coupled to or between the free ends of the lower and the upper poles 22, 23 for reinforcing the lower and the upper poles 22, 23 and for forming a stable triangular structure, and a handle or tubular member 29 is coupled between the upper ends 28 of the upper poles 23 or of the braces 27 or of the frames 20, 21 for being gripped or grasped by the user (FIG. 7) to conduct various kinds of horizontal bar exercises, the user may also grip or grasp the rod 10 to conduct various kinds of horizontal bar exercises. It is to be noted that the tubular member 29 is preferably parallel to the rod 10 and may be suitably supported and located in front of the side moldings 90 with the inclinations of the lower and the upper poles 22, 23 for preventing the user from being interfered by the side moldings 90.

The doorway mounted horizontal bar 1 in accordance with the present invention further comprises two auxiliary supports 30, 31 each including a Z or N or S-shaped post or lever 32 having a lower bent segment 33 and an upper bent segment or handle 34, in which it is preferable, but not necessarily that the segment 33 and the handle 34 are parallel to each other, and the segment 33 and the handle 34 are attached or mounted or secured or coupled to the rod 10 and the frames 20, 21 with couplers or coupling devices 50, 51 respectively. For example, the coupling devices 50, 51 each include a barrel 52 for slidably receiving or engaging with the segment 33 and the handle 34, and each include an oblong hole or channel 54 formed therein for slidably receiving or engaging with a latch or fastener 35 which is attached or mounted or secured to the segment 33 and the handle 34 for adjustably mounting or securing the coupling device 50, 51 on the segment 33 and the handle 34.

The coupling devices 50, 51 each further include a holder 55 attached or mounted or secured or coupled to the barrel 52 with weldings or braces or ribs 56, and disposed or attached or mounted or arranged perpendicular to the barrel 52, the holder 55 includes a semi-cylindrical structure having a U-shaped cross section and having a compartment 57 formed therein for receiving or engaging with the rod 10 or the frames 20, 21, for example, the compartment 57 of the holder 55 of the coupling device 50 may be provided for receiving or engaging with the upper ends 28 of the upper poles 23 or of the braces 27 or of the frames 20, 21 or for engaging with the tubular member 29 and for detachably and adjustably attaching or mounting or securing the coupling device 50, 51 and the auxiliary supports 30, 31 to the rod 10 and the frames 20, 21.

The coupling devices 50, 51 each further include a groove 58 formed therein, such as formed in the ribs 56 or formed between the barrel 52 and the holder 55 for receiving or engaging with a quick release fastening device 6, in which the quick release fastening device 6 includes a belt or strap 60 for engaging through the groove 58 of the coupling device 50, 51 and for engaging or wrapping or winding around the holder 55 and the rod 10 and the frame 20, 21, and includes a ring or loop 61 attached or mounted or secured or coupled to one end of the strap 60, and includes one or more hook and loop fastening members 62 attached or provided on the strap 60 for engaging with each other and for detachably and adjustably attaching or mounting or securing the coupling device 50, 51 and the auxiliary supports 30, 31 to the rod 10 and the frames 20, 21. The auxiliary supports 30, 31 each include a handle or handgrip 36 attached or mounted or secured to the upper bent segment or handle 34 for being gripped or grasped by the user.

In operation, as shown in FIG. 7, the straps 60 of the quick release fastening devices 6 may be released for releasing the auxiliary supports 30, 31 from the rod 10 and the frames 20, 21 and for allowing the auxiliary supports 30, 31 to be moved toward the side portions of the rod 10 and the tubular member 29 and for allowing the user to grip or grasp the rod 10 and/or the tubular member 29 and to conduct various kinds of horizontal bar exercises with the rod 10 and/or the tubular member 29. As shown in FIG. 8, the auxiliary supports 30, 31 may also be adjustably attached or mounted or secured to the rod 10 and the frames 20, 21 and spaced from each other for a suitable or predetermined distance for being gripped or grasped by the user and for allowing the user to conduct various kinds of parallel bar exercises.

Accordingly, the doorway mounted horizontal bar in accordance with the present invention includes one or more longitudinal or lateral bars or rods or handles and includes a parallel bar structure or device for allowing the user to conduct various kinds of exercises with a single exercising mechanism or apparatus without additional parallel bar structure or device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A doorway mounted horizontal bar comprising:

a rod including two end portions for attaching to two side moldings of a doorway, a frame attached to each of said end portions of said rod, and said frames each including an upper end, a tubular member coupled between said upper ends of said frames for being grasped by a user, and two auxiliary supports each including a lower segment attached to said rod, and each including an upper handle attached to said upper end of said frame for being grasped by the user.

2. The doorway mounted horizontal bar as claimed in claim 1, wherein said lower segments of said auxiliary supports are each attached to said rod with a coupling device.

3. The doorway mounted horizontal bar as claimed in claim 2, wherein said coupling device includes a barrel for receiving and engaging with said lower segment and includes a holder having a compartment formed therein for receiving and engaging with said rod.

4. The doorway mounted horizontal bar as claimed in claim 3, wherein said barrel includes a channel formed therein for slidably receiving and engaging with a fastener which is secured to said lower segment for adjustably mounting said coupling device to said lower segment.

5. The doorway mounted horizontal bar as claimed in claim 3, wherein said holder includes a semi-cylindrical structure having a U-shaped cross section and having said compartment formed therein for receiving and engaging with said rod.

6. The doorway mounted horizontal bar as claimed in claim 3, wherein said coupling device includes a groove formed between said barrel and said holder for receiving and engaging with a quick release fastening device and for detachably and adjustably attaching and securing said coupling device and said auxiliary support to said rod.

7. The doorway mounted horizontal bar as claimed in claim 6, wherein said quick release fastening device includes a strap for engaging through said groove of said coupling device and for engaging around said holder and said rod.

8. The doorway mounted horizontal bar as claimed in claim 1, wherein said handles of said auxiliary supports are each attached to said frame with a coupling device.

9. The doorway mounted horizontal bar as claimed in claim 8, wherein said coupling device includes a barrel for receiving and engaging with said handle and includes a holder having a compartment formed therein for receiving and engaging with said frame.

10. The doorway mounted horizontal bar as claimed in claim 9, wherein said barrel includes a channel formed therein for slidably receiving and engaging with a fastener which is secured to said handle for adjustably mounting said coupling device to said handle.

11. The doorway mounted horizontal bar as claimed in claim 9, wherein said holder includes a semi-cylindrical structure having a U-shaped cross section and having said compartment formed therein for receiving and engaging with said frame.

12. The doorway mounted horizontal bar as claimed in claim 9, wherein said coupling device includes a groove formed between said barrel and said holder for receiving and engaging with a quick release fastening device and for detachably and adjustably attaching and securing said coupling device and said auxiliary support to said frame.

13. The doorway mounted horizontal bar as claimed in claim 12, wherein said quick release fastening device includes a strap for engaging through said groove of said coupling device and for engaging around said holder and said frame.

14. The doorway mounted horizontal bar as claimed in claim 8, wherein said frame includes a lower pole and an upper pole having a coupling portion secured to said rod, and includes an outwardly extended segment for engaging with said side moldings, and includes a brace attached to said lower and said upper poles for reinforcing said lower and said upper poles and for forming a stable triangular structure, and said tubular member is coupled between said braces of said frames.

* * * * *